US005841343A

United States Patent [19]

Hapke et al.

[11] Patent Number: 5,841,343

[45] Date of Patent: Nov. 24, 1998

[54] BUZZER WITH ROTARY VOLUME ADJUSTMENT

[75] Inventors: Kenyon A. Hapke, Libertyville, Ill.; William Roos, Colgate; Spencer C. Schantz, Dousman, both of Wis.

[73] Assignee: U.S. Controls Corporation, New Berlin, Wis.

[21] Appl. No.: 515,343

[22] Filed: Aug. 15, 1995

[51] Int. Cl.[6] ..... G08B 3/00

[52] U.S. Cl. ..... 340/390.1; 340/390.2; 340/384.1; 340/398.1; 340/398.2; 381/107

[58] Field of Search ..... 340/392.2, 390.1, 340/384.1, 390.2, 398.1, 398.2, 401.1; 116/149; 381/107

[56] References Cited

U.S. PATENT DOCUMENTS

| | | | |
|---|---|---|---|
| 3,815,082 | 6/1974 | Schantz et al. | 339/221 |
| 3,927,403 | 12/1975 | Schantz | 340/396 |
| 3,958,094 | 5/1976 | Schantz et al. | 200/283 |
| 3,992,687 | 11/1976 | Schantz et al. | 335/247 |
| 4,112,402 | 9/1978 | Schantz | 335/252 |
| 4,134,698 | 1/1979 | Schantz | 403/3 |
| 4,654,637 | 3/1987 | Schantz | 340/402 |

FOREIGN PATENT DOCUMENTS 2546640 10/1975 Denmark .

*Primary Examiner*—Jeffery Hofsass
*Assistant Examiner*—Julie B. Lieu
*Attorney, Agent, or Firm*—Quarles & Brady

[57] ABSTRACT

A electromechanical buzzer provides a rotational volume control having a flange extending over the armature of the buzzer with a downwardly extending wedge surface reducing the vibrational range of the armature. The wedge surface is oversized so that when the armature is compressed against its associated electromagnet coil, the armature may move upward against a spring to complete its rotational travel without binding. Detent and stops on the rotational operator shaft are constructed to permit assembly of the operator shaft to the cover without interference between the parts of the detent and stop divided between the cover and the rotational operator shaft and then to permit a rotation of the operator shaft to engage the stops and detent components in a second angular range and constrain rotation to that second angular range thereafter. Assembly of the detent components reduces play in the detent such as might permit movement of the rotational operator shaft under the vibration caused by the buzzer.

16 Claims, 3 Drawing Sheets

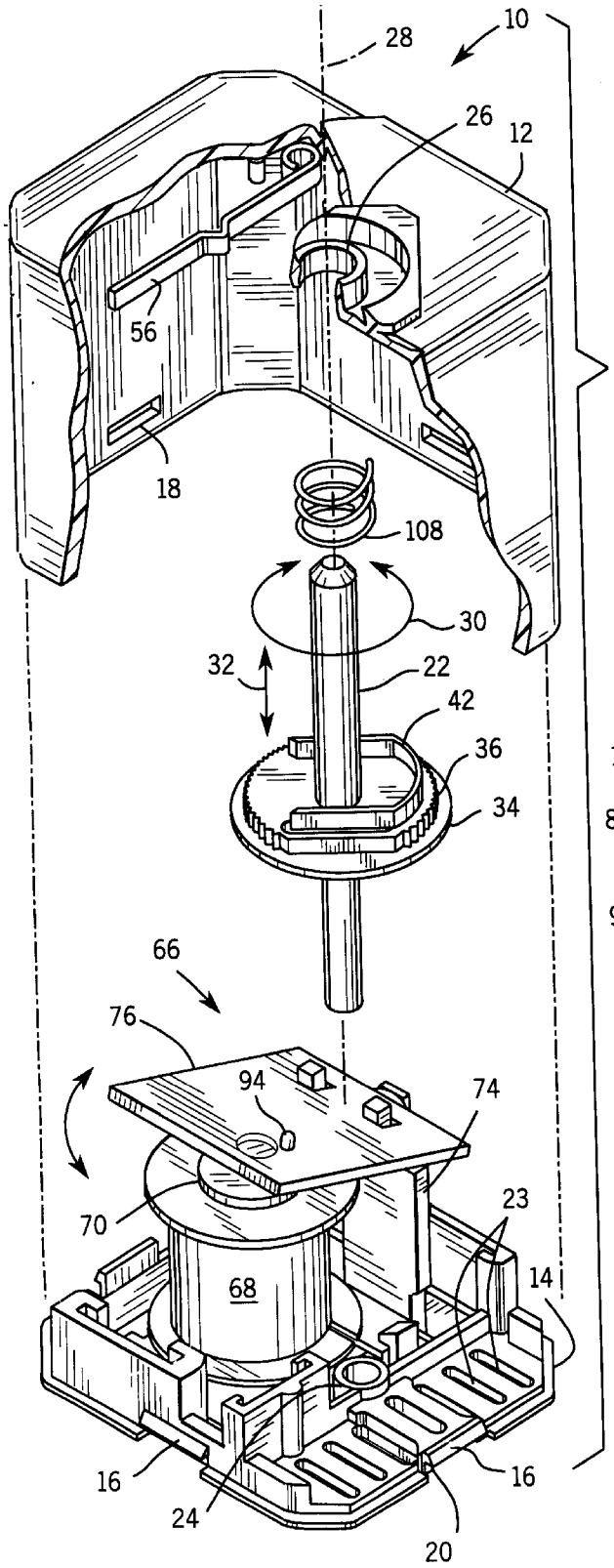
FIG. 1
FIG. 2
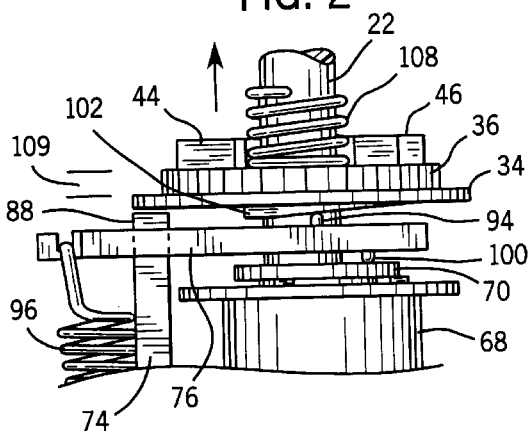

FIG. 3
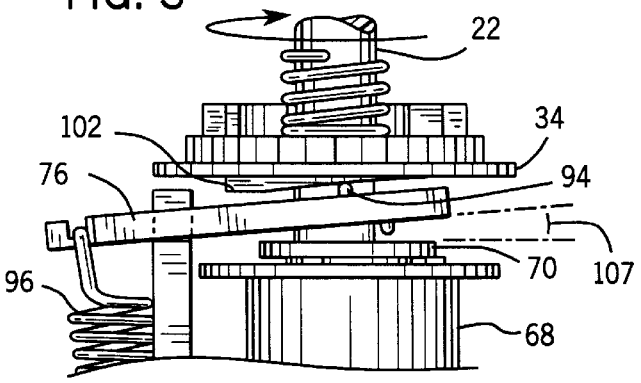
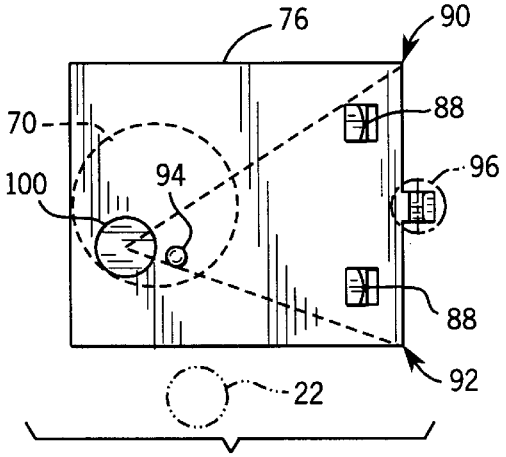
FIG. 12
FIG. 10
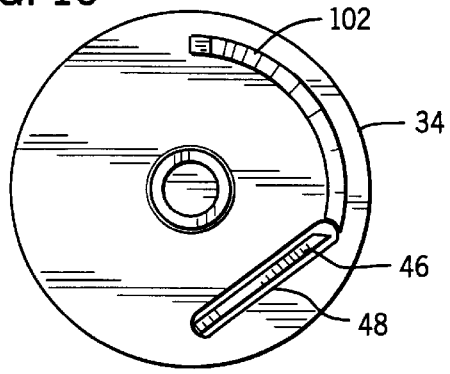
FIG. 13
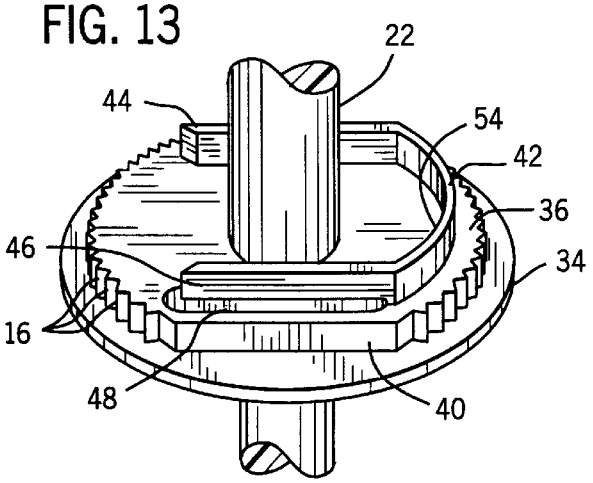
FIG. 11
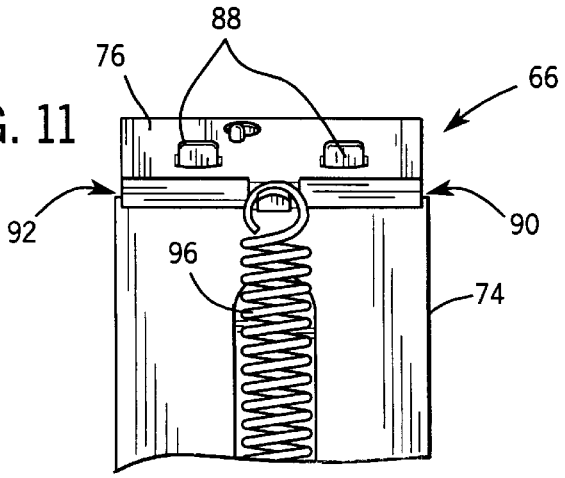

BUZZER WITH ROTARY VOLUME ADJUSTMENT

FIELD OF THE INVENTION

The present invention concerns electromechanical buzzers, and in particular, a buzzer having a rotary volume control.

BACKGROUND OF THE INVENTION

Residential clothes dryers may have an electromechanical buzzer that is activated when the clothes drying cycle is complete yet while the drum containing the clothes is still rotating. The buzzer signals the user to remove the clothes from the dryer before the drum stops rotating. Removal of the clothes at this time prevents wrinkles in the clothes from setting as they may if the clothes rest for a significant period of time in the stationary drum without being folded or hung.

The buzzer may be electromechanical, employing an electromagnet operated by alternating current which creates a pulsating magnetic field to attract a metal armature. Vibration of the armature against a metallic core of the electromagnet produces the buzzing sound.

In some circumstances, the buzzer must be loud enough to be heard at a considerable distance, for example, when the dryer is placed in the basement of a multi-floor residence. In other circumstances, for example, in a small apartment, a lower volume would be preferred. For this reason, it is desirable to provide the buzzer with a convenient volume control accessible to the user.

One method of providing such volume control uses a screw element to progressively restrict the motion of a vibrating buzzer element. While this approach can provide a familiar rotary-type control, it requires the maintenance of close tolerances—in particular the initial height of the screw above the vibrating element, or else the control range is unpredictable. With normal manufacturing tolerances, and if positive rotational stops are provided to prevent the user from overtightening the screw element, a full range of control of the buzzer from mute to full volume will frequently not be obtained.

SUMMARY OF THE INVENTION

The present invention provides a volume control for a buzzer having both positive rotational stops and a well-defined rotational control range. A rotating disk having a wedge-shaped surface restricts the travel of the vibrating armature to a progressively greater degree with rotation of the disk. At the extreme limit of rotation, after the travel of the armature has been reduced to zero, the disk moves axially from the armature against the force of a spring. Thus, a full range of rotation is accommodated and muting of the buzzer is ensured despite the accumulation of normal tolerances in the distance between the wedge surface and the armature.

Specifically, the buzzer includes an electromagnet producing a pulsating magnetic field and a magnetically attractable armature positioned adjacent to the electromagnet to vibrate under the influence of the pulsating magnetic field within a vibration range having a first stop-point at the electromagnet and a second stop point away from the electromagnet. An operator shaft supported to rotate about an axis has a coaxially mounted flange extending perpendicularly to the axis and over the armature. The wedge surface extends axially downward from the flange to provide the second stop point at a point on the wedge surface dependent on the rotation of the operator shaft. The operator shaft may slide axially with respect to the armature and the armature may have a first spring for biasing the armature away from the electromagnet with a first force. The operator shaft may be biased with a second spring toward the armature with the second force greater than the first force. In this way, when the wedge surface has reduced the vibration range of the armature to zero, the operator shaft may still rotate by moving axially from the armature against the second spring.

Thus, it is one object of the invention to provide a reliable muting of the buzzer at one end of the rotational range of travel of the operator shaft such as accommodates normal variation in the dimensions of the components of the buzzer. With the spring bias of the operator shaft, the wedge may be made oversized to ensure that vibration of the armature may be restrained yet without risking binding between the wedge and the armature.

A detent assembly may be located between the shaft and a housing, the detent having a spring loaded pawl and a tooth surface, the spring loaded pawl engaging the toothed surface when the shaft is in a second range of angular positions and the spring loaded pawl being free from engagement with the toothed surface when the shaft is in a first range of angular positions. A stop assembly between a shaft and cover may have a first and second stop wall that abut when the shaft is at an angular position separating the first and second angular range. The second stop wall may be pivotally mounted to flex only in one direction to allow rotation of the shaft from the first range of angular positions to the second range of angular positions but not from the second range of angular positions to the first range of angular positions.

Thus, it is another object of the invention to permit the buzzer of the present invention to be simply assembled. The operator shaft may be inserted into supporting apertures when in the first angular position without interference between the spring loaded pawl and the toothed surface and then rotated to and retained in the second angular range.

The spring loaded pawl may be a leaf spring having a pawl extending toward the toothed wheel. A leaf spring may have a loop formed in the first end engaging an undersized bore in the cover. The cover may slidably support a second end of the leaf spring against rotation of the leaf spring about the bore. The detent surface may be sized to simultaneously contact opposing surfaces of adjacent teeth in the toothed surface when engaging the tooth surface.

Thus it is another object of the invention to provide a detent system without perceptible looseness at the operator shaft. The loop formed in the leaf spring provides a simple method of fixing the detent against tangential motion and the sizing of the detent with respect to the teeth prevents play at the interface between the detent and the teeth.

The foregoing and other objects and advantages of the invention will appear from the following description. In the description, reference is made to the accompanying drawings which form a part hereof and in which there is shown by way of illustration, a preferred embodiment of the invention. Such embodiment does not necessarily represent the full scope of the invention, however, and reference must be made therefore to the claims herein for interpreting the scope of the invention.

BRIEF DESCRIPTION OF THE DRAWINGS

FIG. 1 is an exploded perspective view of a buzzer of the present invention showing the operator shaft mounted for rotational and axial movement and having a flange extending outward over the armature of the buzzer;

FIG. 2 is a simplified elevational view of the buzzer and flange of FIG. 1 showing a wedge surface extending downward from the flange, the flange being rotated to a position so that the wedge surface stops motion of the armature thereby disabling the buzzer;

FIG. 3 is a figure similar to that of FIG. 2 showing the flange at a different rotational position presenting a reduced thickness of the wedge surface to the armature allowing motion of the armature in vibration;

FIG. 10 is a plan view looking up on the flange of the operator shaft of FIG. 1 showing the wedge surface and a cutaway of the flange such as permits flexing of one flange mounted stop wall;

FIG. 11 is an elevational view of the armature of FIG. 1 showing points about which the armature pivots;

FIG. 12 is a plan view of the armature of FIG. 1 showing points about which the armature pivots and points of contact between the armature, the underlying core, and the overlying wedged surface of the flange of FIG. 1;

FIG. 13 is a detailed fragmentary view of the operator shaft and flange of FIG. 1 showing the cantilevered end of the stop wall and the region of reduced radius which operate to facilitate assembly of the present invention.

DETAILED DESCRIPTION OF THE PREFERRED EMBODIMENT

Figure 4:
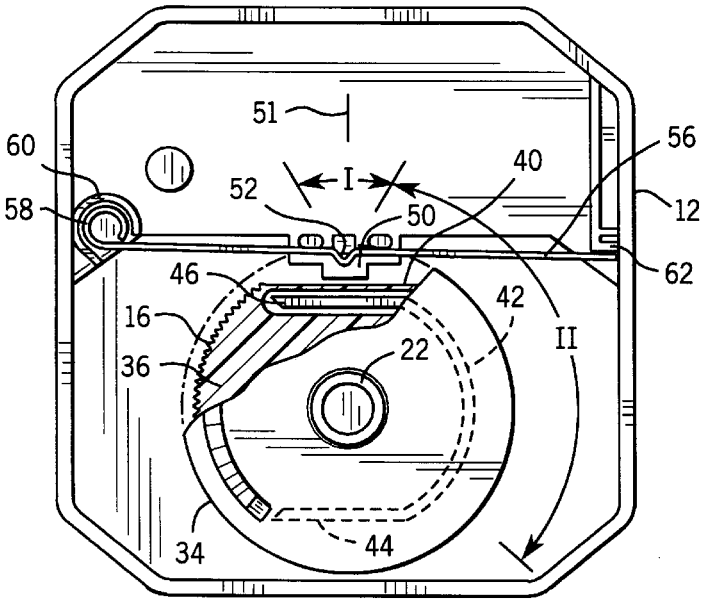
FIG. 4 is a plan view looking up into the cover of FIG. 1 with the operator shaft and flange installed therein and with partial cutaway from the flange showing a detent assembly holding the operator shaft at a given angular position with respect to the cover and a stop assembly for limiting the rotation of the operator shaft and showing two angular ranges I and II, the first being an assembly position and the second being a normal operating range of the operator shaft.

Referring now to FIG. 1, the buzzer 10 of the present invention includes a box shaped cover 12 having a bottom open face receiving a generally rectangular base 14 to provide an enclosed volume.

Extending outward from each of the four edges of the base 14 along the plane of the base 14 are teeth 16 that may be received in corresponding slots 18 formed in the lower inner edges of cover 12. The walls of cover 12 flex outward to slide past the teeth 16 until the teeth 16 reach the slots 18 and then walls flex inward to engage the teeth 16 holding the cover 12 to the base 14. A channel 20 is cut upward through the base 14 under the teeth 16 to permit a screwdriver or the like to be inserted within the channel to disengage the cover 12 from the teeth 16 if it is desired to remove the cover 12 from the base 14.

The base 14 includes a number of slot shaped apertures 23 providing ventilation for the components interior to the volume enclosed by cover 12 and base 14 and to permit sound generated by the buzzer 10 to escape to the outside air.

Base 14 and the cover may be molded of thermoplastic by injection molding techniques well known in the art.

A cylindrical operator shaft 22 extends vertically upward from a socket 24 formed in the base 14 and passes through the volume enclosed by the cover 12 and the base 14 and out of a hole 26 cut through an upper wall of the cover 12. Walls of the hole 26 and of the socket 24 support the operator shaft 22 for rotation 30 about an axis 28 and for axial sliding 32 along the axis 28.

The operator shaft 22 supports, about midway along its height, an outwardly extending disk-shaped flange 34 generally coaxial with the operator shaft 22. A toothed wheel 36 abuts the top surface of the flange 34 so as to also be generally coaxial with the operator shaft 22.

Referring also to FIG. 13, the toothed wheel 36 is generally circular with teeth 16 extending radially out from its periphery. On one side of the toothed wheel 36 is a flat 40 cut along a cord of the circular periphery of the toothed wheel 36 and providing a region of reduced radius of the toothed wheel 36. A rotational reference line 51, shown in FIG. 4, describing the position of operator shaft 22 with respect to the cover 12 is defined as a line of radius outward from operator shaft 22 normal to the flat 40.

Referring also to FIGS. 10 and 13, affixed to the upper surface of the toothed wheel 36 is a U-shaped ridge, the parallel legs of the U forming a first and second stop wall 44 and 46 on opposed sides of operator shaft 22. Stop wall 44 is attached to the upper surface of the toothed wheel 36 over its entire length. However, stop wall 46 extends over a slot 48 passing through the toothed wheel 36 and flange 34 and thus stop wall 46 is free to flex along the surface of the toothed wheel 36 about its juncture with the curved portion of the U-shaped ridge 42. Stop wall 46 is positioned adjacent to and generally parallel to flat 40.

It will be understood that the slot 48 permits the molding of the operator shaft 22 and flange 34, toothed wheel 36 and U-shaped ridge 42 as a single part with the mold tool extending through the slot 48 to prevent attachment of the wall 46 to the upper surface of the toothed wheel 36.

Referring now to FIG. 4, a cover stop 50 extends downward from the inner surface of the top of the cover 12 to a position adjacent to but not touching the flat 40 when the operator shaft 22 is inserted through hole 26 with the rotational reference line 51 rotated to within a first angular range indicated by I and generally subtending the cover stop 50. Positioned adjacent to the cover stop 50 is a V-shaped pawl 52 pointing toward the operator shaft 22 and formed in the middle of a leaf spring 56, the latter extending generally perpendicular to a line drawn between operator shaft 22 and cover stop 50. Pawl 52 moves inward and outward by a bowing action of the leaf spring 56.

When the operator shaft 22 is positioned with reference line 51 within the angular range I, there is also no contact between the toothed wheel 36 and the pawl 52. Thus, assembly of the operator shaft 22 into the cover 12 is unobstructed either by cover stop 50 and pawl 52.

Figure 5:
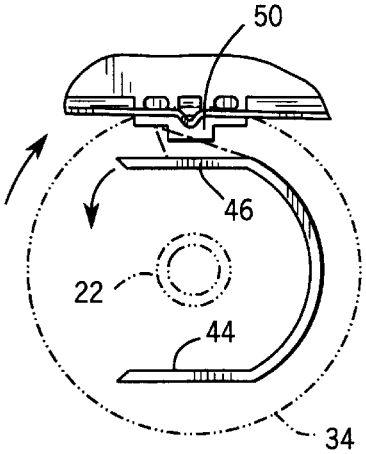
FIG. 5 is a schematicized detail of FIG. 4 showing a flexing inward of a stop wall on the flange to permit rotation of the operator shaft from the installation position I to the normal operating position II.

Referring now to FIG. 5, a clockwise rotation of the operator shaft 22 and flange 34 (looking upward into the cover 12) causes the cover stop 50 to strike an outer surface of the stop wall 46. The force between the cover stop 50 and stop wall 46 has a significant component perpendicular to the length of the stop wall 46 and thus the wall 46 may readily flex inward permitting the flange 34 to be further rotated until the rotational reference line 51 is within the angular range II.

Referring again to FIG. 4, when the operator shaft 22 is rotated to the angular range II, the pawl 52 may engage the teeth 16 on the toothed wheel 36. Thus, a simple rotation of the operator shaft 22 brings the previously uninterfering pawl 52 into engagement with the teeth 16 of the toothed wheel 36.

Figure 6:
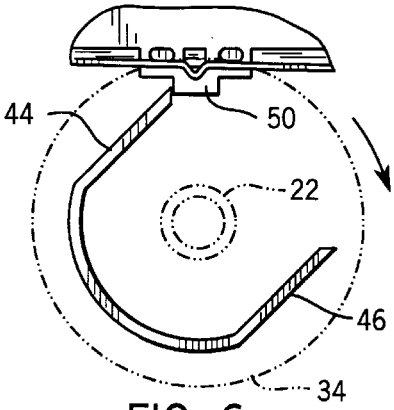
FIG. 6 is a figure similar to that of FIG. 5 showing abutment of the stop wall against a cover stop when the operator shaft is in the normal operating range II with extreme clockwise rotation.

Referring now to FIG. 6, further clockwise rotation of the flange 34 causes the wall 44 to strike the cover stop 50. In this case, wall 44 does not flex because it is affixed along its entire length to the surface of the toothed wheel 36 and further rotation of the flange 34 in the clockwise direction is prevented.

Figure 7:
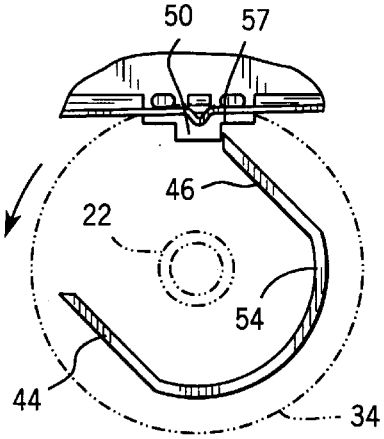
FIG. 7 is a figure similar to that of FIG. 6 showing the abutment of the stop wall and the cover stop in the normal operating range II for extreme counter clockwise rotation.

Referring now to FIG. 7, counter clockwise rotation of the flange 34 again brings wall 46 into contact with cover stop 50. In this case, with rotation in the counter clockwise direction, the force between cover stop 50 and wall 46 is directed primarily along the length of wall 46 toward its effective pivot point 54 and thus does not cause a flexing of wall 46. Further the surface of cover stop 50 provides a notch 57 at the point of contact between the wall 46 and cover stop 50, the notch 57 tending to trap the free end of wall 46 preventing flexure of that wall 46. Accordingly, further counter clockwise rotation of the flange 34 is prevented and the operator shaft 22 is free only to move now in the second range of angular rotation II.

It will thus be understood that assembly of the operator shaft 22 to the cover 12 may be accomplished without interference between the pawl 52 and the toothed wheel 36 or between the cover stop 50 and the stop walls 44 or 46 simply by installing the operator shaft 22 with reference line 51 in first angular range I. The operator shaft 22 may then be moved by rotation so the reference line 51 is in the second angular range II, i.e., the normal operating range of the operator shaft 22, where it is henceforth restrained to that angular range II by the actions of the stop walls 44 and 46.

Figure 8:
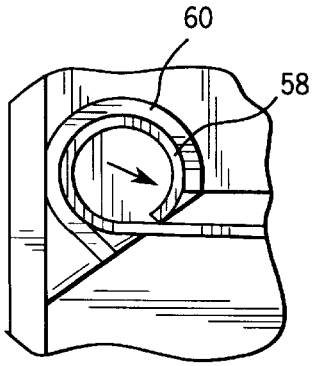
FIG. 8 is a detail of the mounting of a leaf spring for the detent of FIG. 4 to the cover such as prevents tangential movement of the leaf spring that would lead to play in the detent action.

Referring to FIGS. 4 and 8, the leaf spring 56 providing an inward bias of the pawl 52 toward the operator shaft 22, has a loop 58 formed in one end that may be received by a slotted bore 60 extending downward from the inner surface of the top of the cover 12, the bore 60 having a radius slightly smaller than the loop 58 so that an elastic press fit between the two may be obtained.

A second end of the leaf spring 56 is flat and may be retained against outward movement away from operator shaft 22 by a wall 62 extending downward from the cover 12. The second end of the leaf spring 56 abutting wall 62 is free to slide on the surface of wall 62 thus accommodating a flexure of the leaf spring 56 allowing pawl 52 to move radially inward and outward as it engages teeth 16 on toothed wheel 36. Nevertheless, motion of the leaf spring 56 along its length is prevented by the interfitting of the open loop 58 and 60. This simple yet tight attachment between the leaf spring 56 and the cover 12 prevents play in the detenting action of the pawl 52 and teeth 16 such as would occur if leaf spring 56 could slide back and forth along its length.

Figure 9:
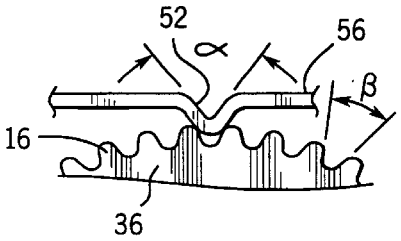
FIG. 9 is a detail of the detent assembly of FIG. 4 showing contact between the pawl of the detent and a toothed wheel such as eliminates play between these surfaces.

Referring now to FIG. 9, the pawl 52 is a V-shaped bend in the leaf spring 56 having an angle $\alpha$ that is generally greater than the angle $\beta$ formed by the trough between teeth 16 on toothed wheel 36. Thus pawl 52 when resting between teeth 16 generally contacts the side walls of two adjacent teeth 16 simultaneously preventing movement of the toothed wheel 36 without flexure of the leaf spring 56, such flexure being manifest as a resistance to the rotation of the operator shaft 22. In contrast, if the pawl 52 contacted the toothed wheel 36 only at the bottom of the trough between teeth 16, some rotation of the toothed wheel 36 could occur prior to significant flexing of the leaf spring 56, such rotation as would result in perceptible play of the operator shaft.

Reduced play between the toothed wheel 36 and the pawl assembly of the leaf spring 56 improves the feel of the control and reduces the possibility of slippage of the volume setting of the buzzer during operation of the buzzer such as might be promoted by looseness in the detenting action.

Referring now to FIGS. 1 and 2, the flange 34 on the operator shaft 22 extends outward over a buzzer element 66 comprising generally an electromagnet formed of electromagnet coil 68 wrapped about a metallic core 70. The core 70 extends upward from the base 14 and presenting a flat upwardly exposed head surface. The lower extent of cylindrical operator shaft 22 is not shown for clarity.

Referring also to FIG. 11, a vertically extending metal frame 74 adjacent to the electromagnet coil 68 pivotally supports a generally horizontal armature 76 at the frame's upper edge. The armature 76 may be magnetically attracted and extends from the upper edge of the frame 74 over the core 70 to pivot up and down about the upper edge of the frame 74 when released or attracted by the electromagnet coil 68 and core 70. When the electromagnet coil 68 is energized with alternating current, the armature 76 is repeatedly attracted to and released from the core 70 generating a buzzing sound.

Referring to FIGS. 1, 2, 11 and 12, the armature 76 is pivotally held adjacent to the upper edge of the frame 74 by means of pins 88 formed in the frame 74 and extending upward from the frame 74 to fit loosely through corresponding apertures in an edge of the armature 76. The upper edge of the frame 74 is concave and the edge is sharpened to an acutely angled knife edge (visible in FIG. 2) so that the armature 76 contacts the upper edge of the frame 74 only at two points 90 and 92 which define a pivot axis transecting both points about which the armature 76 pivots. When the electromagnet coil 68 draws the armature 76 downward against the top of the core 70, the armature 76 contacts the core 70 at a first stop point defined by downwardly extending boss 100, evident as a depression in the upper surface of the armature 76, abutting the top of the core 70.

The contact points of boss 100 and 90 and 92 define a stable plane of support for the armature 76 when it is drawn against the core 70. An upwardly extending stylus 94, having a convex upper surfaces, as seen in FIG. 2, is positioned within a triangle formed by boss 100 and points 90 and 92, so that downward pressure on the stylus 94 does not upset the stable plane defined by the pivot points 90, 92 and the boss 100 in the same way that a weight centered between the three legs of a stool does not tip the stool. Thus, pressure downward on stylus 94 may be used to firmly hold the armature 76 down against the core and points 90 and 92 without vibration. The boss 100 may be displaced toward operator shaft 22, as shown, to reduce the distance the flange of the operator shaft 22 must extend to reach the stylus 94.

When the electromagnet coil 68 is de-energized during transitions of the alternating current, the armature 76 retracts from the top of core 70 by the action of a helical spring 96 attached to one end of the armature 76 but on the opposite side of the armature 76 from the electromagnet coil 68. The spring 96 extends downward in tension outside the "C" of the armature 76, the frame 74 and the top of the core 70 and at its other end is attached to the frame 74.

Referring now to FIGS. 1, 2 and 10, extending from the bottom surface of the flange 34 is a wedge 102 following generally the circumference of the flange 34. The flange 34 is positioned above the armature 76 so that the stylus 94 contacts the wedge surface 102 when the armature is released by the core 70 at a second stop point. The height of this stop point changes as the operator shaft 22 is rotated and the stylus rides along the incline of the wedge surface 102 with rotation of the operator shaft 22.

Referring to FIG. 2, when the operator shaft 22 is rotated so as to increase the thickness of the wedge surface 102 between the flange 34 and the stylus 94 to near a maximum, there will come a point where the armature 76 is pressed downward against the core 70 so as to have no range of vibration between the first and second stop points. As noted, because stylus 94 is within the triangle defined by the support points 90 and 92 of the frame 74 and the upper surface of the core 70 abutting boss 100, the armature is held against the core 70 without instability such as might permit buzzing even in this configuration.

The flange 34, although free to move axially, is held downward toward the armature 76 by helical spring 108 which provides a downward force on the operator shaft 22 greater than the upward force of the armature 76 under the influence of helical spring 96. Spring 108 fits coaxially around operator shaft 22 pressing at one side against the upper surface of toothed wheel 36 and that the other side on the lower surface of the upper wall of cover 12. Excessive downward axial motion of the operator shaft 22 under the influence of spring 108 is prevented by the bottoming out of the cylindrical operator shaft 22 within the socket 24.

With additional rotation of the operator shaft 22, to further increase the thickness of the wedge 102 between the flange 34 and stylus 94 (after the armature 76 has been pressed into contact with the core 70), an upward motion 109 of the operator shaft 22 may occur compressing spring 108. This compression of spring 108 is caused by the force of the stylus 94 against the wedge surface 102 once it is impossible for stylus 94 to further retreat with downward flexing of the armature 76.

The ability for the shaft of operator shaft 22 to move in the axially direction, resisted only by spring 108, permits reasonable manufacturing tolerances in the construction of the wedge 102 and in controlling the height of armature 76 above the socket 24 while ensuring that the wedge surface 102 has sufficient thickness, given those tolerances, so that the armature 76 may be pressed completely against the core 70 and thus so that it can be assured that the buzzer 10 may be disabled with rotation of the operator shaft 22 somewhere within the second angular range II. Any excess thickness of the wedge surface 102 is accommodated by upward motion of the entire flange assembly.

Referring now to FIG. 3, the operator shaft 22 may be rotated now to decrease the thickness of the wedge surface 102 between the flange 34 and the stylus 94 thus permitting the armature 76 to rise from the surface of the core 70. The amount of rise of the armature 76 determines a vibration range 107 through which the armature 76 may move under the influence of the pulsating magnetic field from the electromagnet coil 68. Generally the greater this range 107, the louder the buzzing noise caused by the impact of the armature 76 with the core 70.

The above description has been that of a preferred embodiment of the present invention. It will occur to those that practice the art that many modifications may be made without departing from the spirit and scope of the invention. In order to apprise the public of the various embodiments that may fall within the scope of the invention, the following claims are made.

We claim:

1. A rotating shaft assembly comprising:

a cover having an aperture;

a shaft passing through the aperture of the cover to rotate about an axis through a first and second range of angular positions;

a detent assembly between the shaft and cover, the detent assembly having a spring-loaded pawl and a toothed surface, the spring loaded pawl engaging the toothed surface when the shaft is in the second range of angular positions and free from engagement with the toothed surface when the shaft is in the first range of angular positions; and a stop assembly between the shaft and cover having a first and second stop wall that abut each other when the shaft is at an angular position separating the first and second angular range, wherein the second stop wall is pivotally mounted to flex in one direction to allow rotation of the shaft from the first range of angular positions to the second range of angular positions but not to flex in an opposite direction to allow rotation from the second range of angular positions to the first range of angular positions;

whereby the shaft may be inserted into the cover when positioned in the first angular range without interference between the spring-loaded pawl and the toothed surface and then rotated to and retained in the second angular range.

2. The rotating shaft assembly of claim 1 wherein the toothed surface is the periphery of a wheel coaxially mounted on the shaft, the wheel having a portion of reduced radius that is aligned with the spring-loaded pawl in the first range of angular positions and wherein the spring-loaded pawl is supported by the cover so as to limit the travel of the spring-loaded pawl toward the wheel so as not to contact the portion of the wheel having reduced radius.

3. The assembly of claim 2 wherein the spring-loaded pawl is a leaf spring extending tangentially to the wheel, the leaf spring having a pawl extending outward toward the wheel, and wherein the leaf spring has a loop formed in a first end and engaging an undersized bore in the cover, and wherein the cover slidably supports a second end of the leaf spring against rotation of the leaf spring about the bore and wherein the pawl is sized to simultaneously contact opposed surfaces of adjacent teeth in the toothed surface of the wheel when engaging the toothed surface of the wheel.

4. The assembly of claim 2 wherein the first stop wall extends from the cover toward the wheel and wherein the second stop wall is attached to the wheel and wherein a third stop wall is also attached to the wheel, the third stop wall together with the second stop wall limiting the rotation of the shaft to the second angular range by abutting the first stop wall at limits of the second angular range.

5. The assembly of claim 2 wherein the second and third stop walls are portions of a C-shaped ridge extending axially upward from the surface of the wheel and wherein the first stop wall extends axially downward from an inner surface of the cover.

6. The assembly of claim 5 wherein the first stop wall is indented at a point of abutment between the second stop wall and the first stop wall to capture an end of the second stop wall preventing flexure of the second stop wall.

7. A buzzer assembly comprising:

an electromagnet producing a pulsating magnetic field;

a magnetically attractable armature positioned adjacent to the electromagnet to vibrate under the influence of the pulsating magnetic field within a vibration range between a first stop point at the electromagnet and a second stop point away from the electromagnet, wherein the armature is mounted to pivot about a line through a first and second pivot point toward the electromagnet to a contact point of the first stop; and wherein the armature has an upwardly extending stylus, the stylus being located within a triangle described by vertices of the first and second pivot point and the contact point of the first stop; and an operator adjusting the distance between the second stop point and the first stop point.

8. The buzzer assembly of claim 7 wherein the operator includes:

a shaft supported to rotate about an axis, the shaft having a coaxially mounted flange extending perpendicular to the axis and over the armature; and a wedge surface extending axially downward from the flange to contact the stylus at a point on the wedge surface dependent on the rotation of the shaft to define the position of the second stop point.

9. The buzzer assembly of claim 7 wherein the stylus is convex to contact the wedge surface at a point.

10. The buzzer assembly of claim 7 wherein the armature includes a downwardly extending boss contacting the electromagnet at the first stop point to define a location of contact on the armature between the electromagnet and the armature.

11. The buzzer assembly of claim 10 wherein the boss is convex to contact the electromagnet at a point.

12. The buzzer assembly of claim 7 wherein the armature is supported by a frame having an end proximate the armature at the first and second pivot points wherein the end of the frame is concave to abut the armature only at the first and second pivot points.

13. The buzzer assembly of claim 12 wherein the end of the frame is an acutely angled edge.

14. The buzzer assembly of claim 7 wherein the armature is supported by a frame having an end proximate the armature at the first and second pivot points and wherein the end of the frame is an acutely angled edge.

15. A buzzer assembly comprising:

an electromagnet producing a pulsating magnetic field;

a magnetically attractable armature positioned adjacent to the electromagnet to vibrate under the influence of the pulsating magnetic field within a vibration range between a first stop point at the electromagnet and a second stop point away from the electromagnet;

a first spring biasing the armature axially away from the electromagnet with a first force;

a shaft supported to rotate about an axis and to slide axially toward the armature to a limit and away from the armature, the shaft having a coaxially mounted flange extending perpendicular to the axis and over the armature; and a second spring for biasing the shaft axially toward the limit with a second force greater than the first force;

a wedge surface extending axially downward from the flange to provide the second stop point at a point on the wedge surface dependent on the rotation of the shaft for contacting the wedge surface to define the position of the second stop;

wherein when rotation of the shaft reduces the vibration range to zero, the shaft may still rotate by moving axially away from the limit against the second spring.

16. The buzzer of claim 15 wherein electromagnet and armature are contained within a housing having at least one aperture sized to provide for both ventilation and the passage of sound.

* * * * *